US009983614B1

(12) United States Patent
Pigott et al.

(10) Patent No.: US 9,983,614 B1
(45) Date of Patent: May 29, 2018

(54) VOLTAGE REFERENCE CIRCUIT

(71) Applicant: NXP USA, Inc., Austin, TX (US)

(72) Inventors: John M. Pigott, Tempe, AZ (US); Ivan Victorovich Kochkin, Tempe, AZ (US); Hamada Ahmed, Tempe, AZ (US)

(73) Assignee: NXP USA, INC., Austin, TX (US)

( * ) Notice: Subject to any disclaimer, the term of this patent is extended or adjusted under 35 U.S.C. 154(b) by 0 days. days.

(21) Appl. No.: 15/362,877

(22) Filed: Nov. 29, 2016

(51) Int. Cl.
*G05F 3/26* (2006.01)

(52) U.S. Cl.
CPC ..... *G05F 3/267* (2013.01)

(58) Field of Classification Search
CPC ..... G05F 3/267
USPC ..... 327/513, 538, 539, 542
See application file for complete search history.

(56) References Cited

U.S. PATENT DOCUMENTS 5,488,329 A 1/1996 Ridgers
7,084,698 B2 8/2006 Khan et al.
7,208,930 B1 * 4/2007 Tran ..... G05F 3/30 323/314
7,456,679 B2 11/2008 Pigott et al.
7,605,578 B2 * 10/2009 Marinca ..... G05F 3/30 323/313
7,710,096 B2 5/2010 Kotchkine et al.
8,305,068 B2 11/2012 Camacho Galeano et al.
2003/0080720 A1 * 5/2003 Ghozeil ..... G05F 3/30 323/313
2005/0012493 A1 1/2005 Rosenthal
2009/0195301 A1 * 8/2009 Narayanan ..... G05F 3/30 327/539
2009/0256628 A1 * 10/2009 Ilkov ..... G05F 3/30 327/543
2010/0308788 A1 12/2010 Sicard
2011/0187445 A1 8/2011 Sicard
2014/0015509 A1 1/2014 Gupta et al.
2015/0054487 A1 2/2015 Kochkin et al.

* cited by examiner

*Primary Examiner* — William Hernandez

(57) ABSTRACT

A reference circuit includes a bandgap core circuit and a cascode amplifier. The bandgap core circuit includes a first bipolar junction transistor (BJT), a second BJT having a control electrode coupled to a control electrode of the first BJT, a first resistor coupled to the first BJT and the second BJT, and a second resistor coupled to the second BJT. The cascode amplifier circuit includes a first branch coupled to the first BJT and a second branch coupled to the second resistor.

20 Claims, 4 Drawing Sheets

VOLTAGE REFERENCE CIRCUIT

BACKGROUND

Field

This disclosure relates generally to voltage reference circuitry, and more specifically, to bandgap voltage reference circuitry in a semiconductor device.

Related Art

Today, it is important to include a stable reference voltage generator on an integrated circuit (IC) die, or chip. For example, circuits that provide a stable reference voltage are used in data converters, analog devices, sensors, and many other applications. These circuits require voltage generators that are stable over manufacturing process variations, supply voltage variations, and operating temperature variations. Such voltage generators can be implemented without modifications of conventional manufacturing processes. A bandgap reference circuit is commonly used as a stable reference voltage generator circuit. However, a bandgap reference circuit for use in low voltage, low power, and extended temperature ranges presents challenges.

BRIEF DESCRIPTION OF THE DRAWINGS

The present invention is illustrated by way of example and is not limited by the accompanying figures, in which like references indicate similar elements. Elements in the figures are illustrated for simplicity and clarity and have not necessarily been drawn to scale.

DETAILED DESCRIPTION

Generally, there is provided, bandgap reference circuitry implemented on a semiconductor integrated circuit that generates a substantially constant reference voltage over an extended temperature range. A folded cascode circuit coupled to a bandgap core circuit allows transistors Q1 and Q2 of the bandgap to operate in a saturation mode where base-collector junction is forward biased. An equalizer circuit including a resistor equalizes $V_{CE}$ values of transistors Q1 and Q2 by matching a voltage drop across the resistor with a voltage drop across a $\Delta V_{BE}$ resistor coupled to Q1 and Q2. With $V_{CE}$ values of transistors Q1 and Q2 matched, extended temperature stability is realized in saturation mode.

Figure 1:
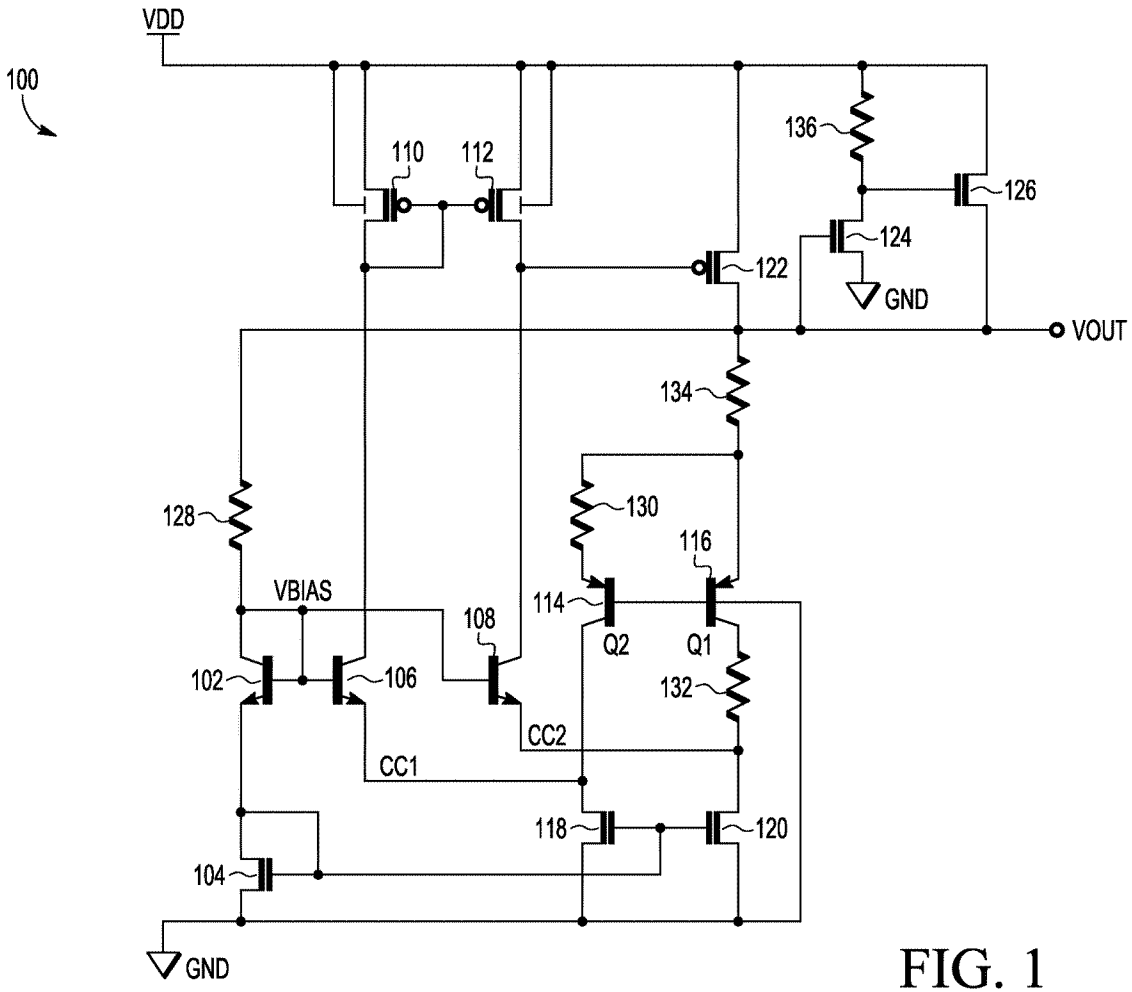
FIG. 1 illustrates, in schematic diagram form, an exemplary bandgap reference generator circuit in accordance with an embodiment of the present disclosure.

FIG. 1 illustrates, in schematic diagram form, an exemplary bandgap reference voltage generator circuit 100 in accordance with an embodiment of the present disclosure. The bandgap reference generator 100 may be suitable for low voltage operation and low power applications. The bandgap reference generator 100 may be characterized as a folded-cascode bandgap generator. The bandgap reference generator 100 includes bandgap core circuitry, cascode amplifier, bias circuitry, output amplifier, startup circuitry, and provides an output voltage VOUT at an output terminal labeled VOUT.

The cascode amplifier circuitry includes NPN bipolar junction transistors (BJT) 106 and 108 coupled P-channel metal-oxide-semiconductor (MOS) transistors 110 and 112 respectively. A current mirror formed with transistors 110 and 112 is coupled between a first voltage supply terminal (labeled VDD) and BJT transistors 106 and 108. A first current electrode of transistor 110 and a first current electrode of transistor 112 are each coupled to the first voltage supply terminal. A nominal operating voltage, typically referred to as VDD, may be provided at the first voltage supply terminal. A body electrode of each transistor 110 and 112 is also coupled to the first voltage supply terminal. A control electrode of each transistor 110 and 112 is coupled to a second current electrode of transistor 110. The second current electrode of transistor 110 is coupled to a first current electrode (collector electrode) of transistor 106, and a second current electrode of transistor 112 is coupled to a first current electrode (collector electrode) of transistor 108. A control electrode (base electrode) of each transistor 106 and 108 is coupled to receive a bias voltage VBIAS provided at an output of the bias circuitry labeled VBIAS. A second current electrode (emitter electrode) of transistor 106 and a second current electrode (emitter electrode) of transistor 108 are each coupled to the bandgap core circuitry at cascode branch nodes labeled CC1 and CC2 respectively.

The bias circuitry includes series coupled resistor 128, NPN BJT 102, and N-channel MOS transistor 104. A first terminal of resistor 128 is coupled to the output terminal of bandgap reference generator 100 labeled VOUT. A second terminal of resistor 128 is coupled to a collector electrode and a base electrode of transistor 102 at the output of the bias circuitry labeled VBIAS. An emitter electrode of transistor 102 is coupled to a first current electrode and control electrode of transistor 104, and a second current electrode of transistor 104 is coupled to a second voltage supply terminal labeled GND. The voltage provided at the second voltage supply terminal may be characterized as ground.

The bandgap core circuitry is coupled to the cascode amplifier and bias circuitry. The bandgap core circuitry includes PNP BJTs 114 and 116 (Q2 and Q1), N-channel MOS transistors 118 and 120, and resistors 130, 132, and 134. Transistors 118 and 120 are coupled between the second voltage supply terminal and the cascode nodes CC1 and CC2 respectively. Transistors 118 and 120 form current sources with transistor 104 of the bias circuitry. A first current electrode of each transistor 118 and 120 is coupled to the second voltage supply terminal. A gate electrode of each transistor 118 and 120 is coupled to the first current and gate electrodes of transistor 104. A second current electrode of transistor 118 is coupled to a collector electrode of transistor 114 at node CC1, and a second current electrode of transistor 120 is coupled to a first terminal of resistor 132 at node CC2. A second terminal of resistor 132 is coupled to a collector electrode of transistor 116. A base electrode of each transistor 114 and 116 is coupled to the second voltage supply terminal. An emitter electrode of transistor 114 is coupled to a first terminal of resistor 130, and an emitter electrode of transistor 116 is coupled to a second terminal of resistor 130. Resistor 130 may be characterized as a $\Delta V_{BE}$ resistor. The second terminal of resistor 130 is coupled to a first terminal of resistor 134, and a second terminal of resistor 134 is coupled to the output terminal of bandgap reference generator 100 labeled VOUT.

The output amplifier and startup circuitry are also coupled to the output terminal of bandgap reference generator 100 labeled VOUT. The output amplifier circuit includes P-channel MOS transistor 122 coupled between the first voltage supply terminal and the VOUT terminal. A first current electrode of transistor 122 is coupled to the first voltage supply terminal, and a second current electrode of transistor 122 is coupled to the VOUT terminal. A control electrode of transistor 122 is coupled to the second current electrode of transistor 112 and the collector electrode of transistor 108. The startup circuitry includes N-channel MOS transistors 124 and 126, and resistor 136. A first current electrode of transistor 124 is coupled to the second voltage supply terminal, and a control electrode of transistor 124 is coupled to the VOUT terminal. A second current electrode of transistor 124 is coupled to a first terminal of resistor 136 and a control electrode of transistor 126. A first current electrode of transistor 126 is coupled to the VOUT terminal. A second terminal of resistor 136 and a second current electrode of transistor 126 are each coupled to the first voltage supply terminal.

In the exemplary bandgap reference generator 100, BJT Q2 is configured with an emitter area seven times larger than BJT Q1. For example, Q2 may be formed as seven transistors of Q1 size connected in parallel, thus establishing a 7:1 ratio of current densities Q1:Q2. In some embodiments, Q2 may be configured to establish other ratios of current densities with Q1. In operation, the circuitry arrangement of bandgap reference generator 100 keeps Q1 and Q2 in saturation mode (e.g., forward biased base-collector junctions). In saturation, transistors Q1 and Q2 effectively have lower output impedance, and collector current is dependent upon base-emitter voltage ($V_{BE}$) as well as collector-emitter voltage ($V_{CE}$). Equalizing $V_{CE}$ of transistors Q1 and Q2 is required for desired performance of bandgap reference generator 100.

A proportional to absolute temperature (PTAT) current is establish through resistor 134 and distributed to Q1 and Q2 branches of the bandgap core circuitry. In turn, a difference between current densities of Q1 and Q2 establishes a $\Delta V_{BE}$ voltage across resistor 130, providing a current through resistor 130. The $V_{BE}$ of transistor Q1 provides a complementary to absolute temperature (CTAT) voltage. Because Q1 and Q2 are operated in saturation mode, resistor 132 is included to equalize $V_{CE}$ values of Q1 and Q2 (e.g., $V_{CE}$ values of Q1 and Q2 are made similar). Thus, it is desirable for the IR drop across resistor 132 to be substantially equal to the IR drop across resistor 130 (e.g., where IR is a current value I through a resistor multiplied by a resistance value R of the resistor). IR drop may also be referred to as voltage drop, where voltage drop is a voltage across the resistor. Resistor 128-136 may be formed from any suitable resistive elements, materials, and structures.

Figure 2:
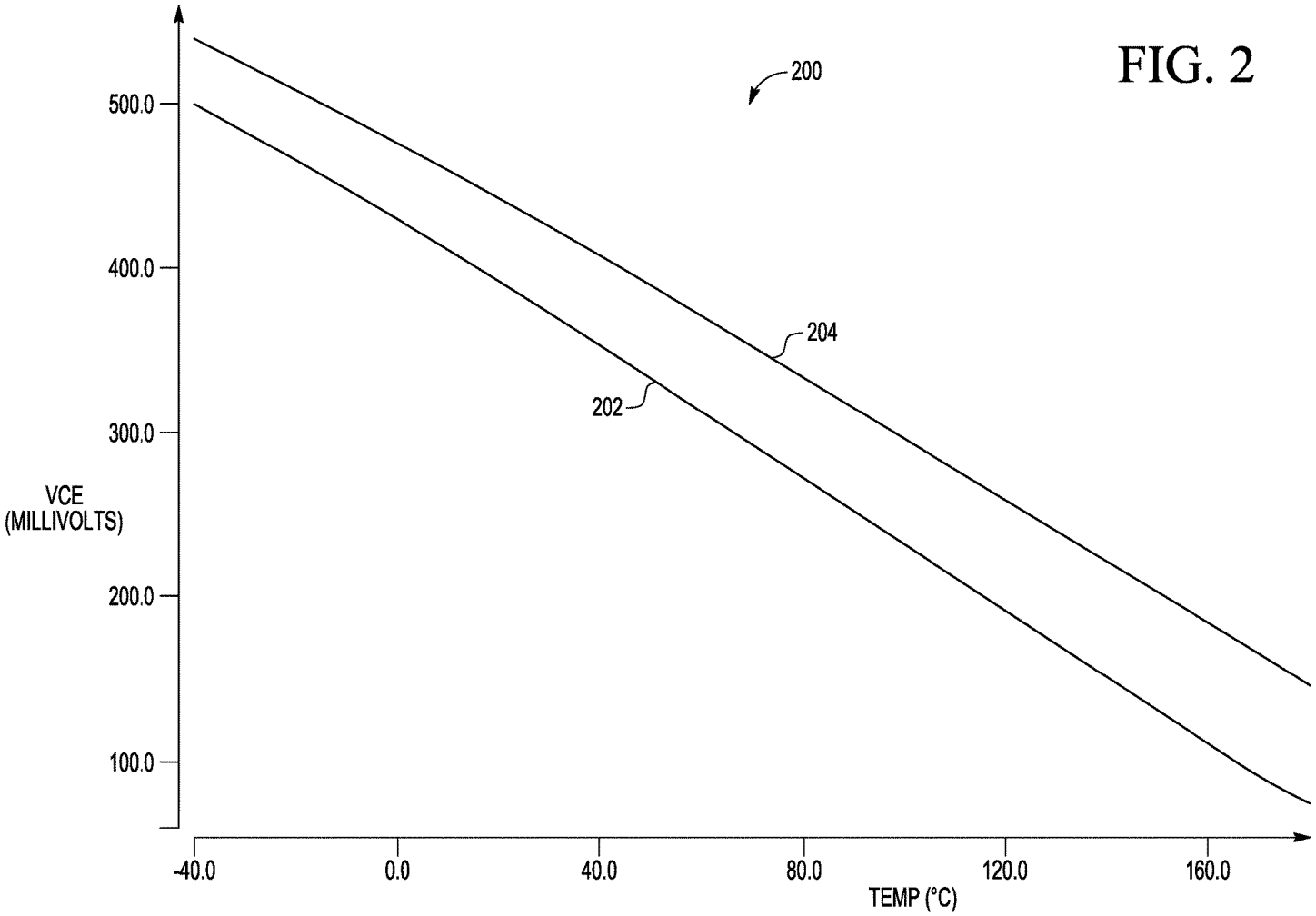
FIG. 2 illustrates, in plot diagram form, exemplary $V_{CE}$ relationship with temperature in accordance with an embodiment of the present disclosure.

FIG. 2 illustrates, in plot diagram form, exemplary $V_{CE}$ relationship with temperature of a bandgap reference generator in accordance with an embodiment of the present disclosure. Temperature values are shown in degrees Centigrade (° C.) on the X-axis, and $V_{CE}$ values are shown in millivolts (mV) on the Y-axis. Plot diagram 200 includes waveforms illustrating $V_{CE}$ voltages for transistors Q1 (204) and Q2 (202) versus temperature, excluding resistor 132 (e.g., bandgap reference generator 100 with collector electrode of Q1 coupled directly to node CC2). Because $V_{CE}$ values of Q1 and Q2 are not matched while in saturation mode, waveform 204 is offset from waveform 202. In this example, waveform 204 is offset from waveform 202 by approximately 50 millivolts (mV)

Figure 3:
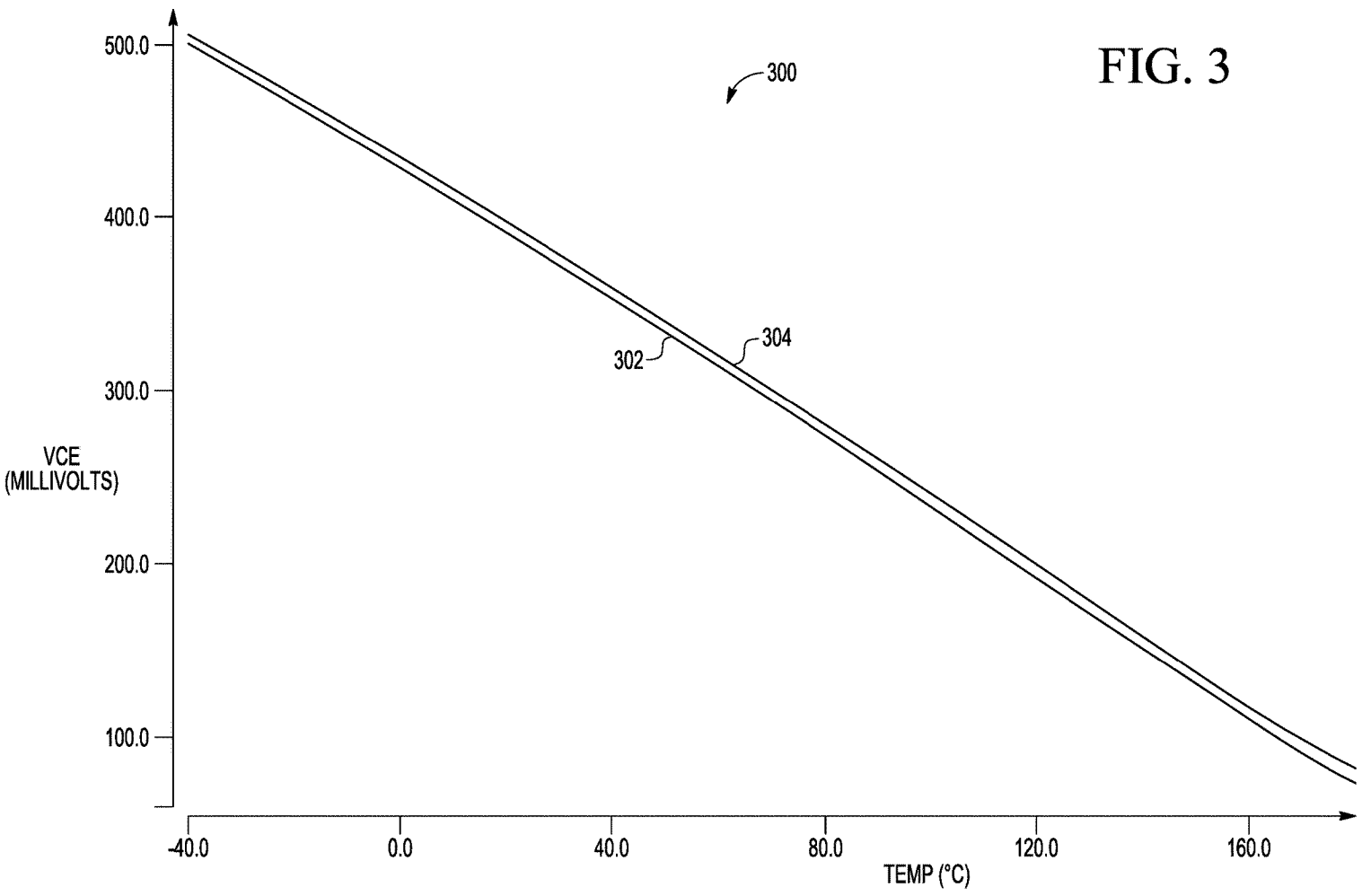
FIG. 3 illustrates, in plot diagram form, exemplary $V_{CE}$ relationship with temperature including equalizing resistor in accordance with an embodiment of the present disclosure.

FIG. 3 illustrates, in plot diagram form, exemplary $V_{CE}$ relationship with temperature of bandgap reference generator 100 in accordance with an embodiment of the present disclosure. Temperature values are shown in degrees Centigrade (° C.) on the X-axis, and $V_{CE}$ values are shown in millivolts (mV) on the Y-axis. Plot diagram 300 includes waveforms illustrating $V_{CE}$ voltages for transistors Q1 (304) and Q2 (302) versus temperature, including resistor 132 as shown in bandgap reference generator 100. Because resistor 132 is configured to have an IR drop substantially equal to an IR drop across resistor 130, $V_{CE}$ values of Q1 and Q2 are closely matched while in saturation mode. In this example, waveform 304 is nearly identical to waveform 302, being offset from waveform 302 by less than 5 mV and providing at least a 10X improvement.

Figure 4:
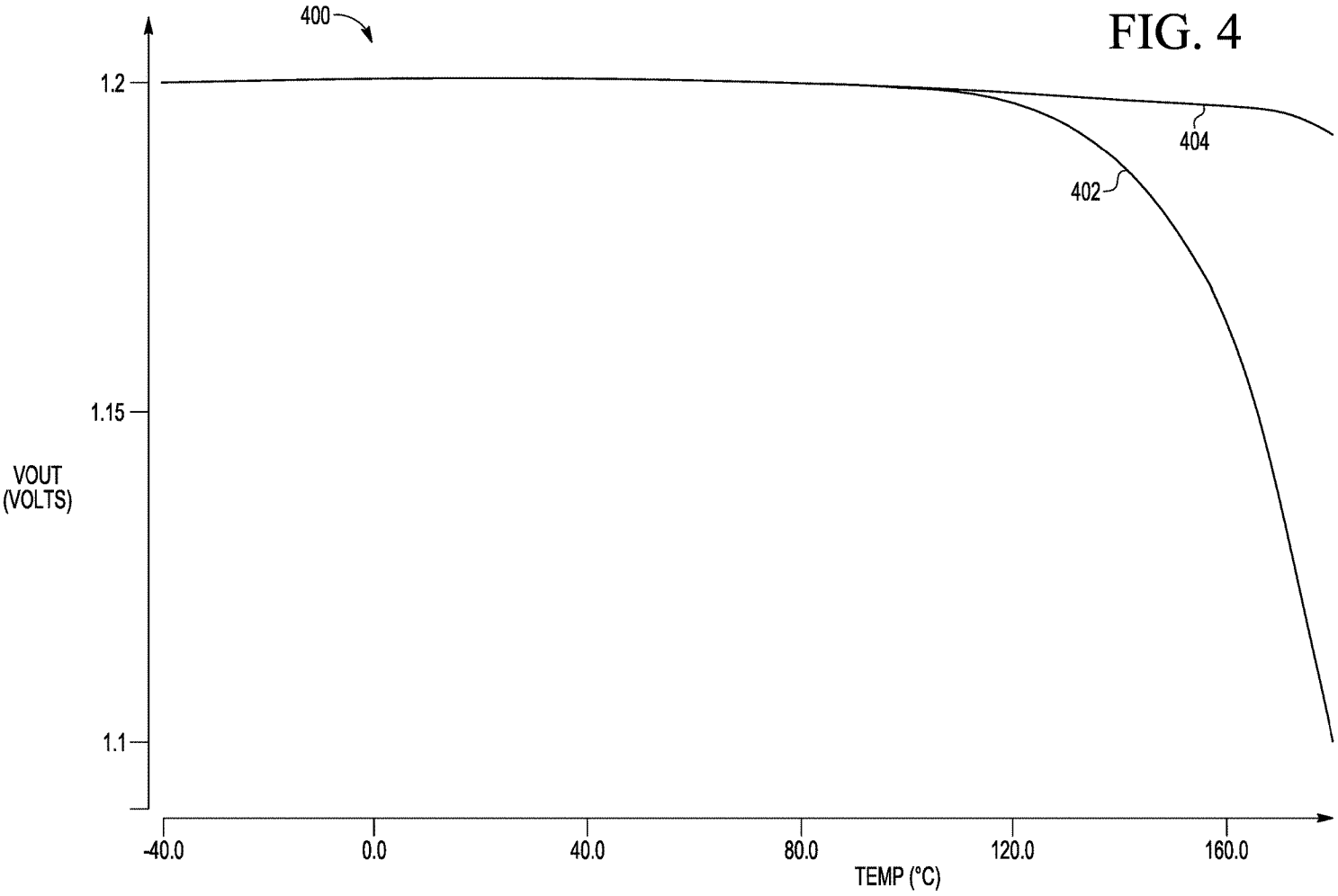
FIG. 4 illustrates, in plot diagram form, an exemplary bandgap reference generator output in accordance with an embodiment of the present disclosure.

FIG. 4 illustrates, in plot diagram form, an exemplary bandgap reference generator output voltage relationship with temperature in accordance with an embodiment of the present disclosure. Temperature values are shown in degrees Centigrade (° C.) on the X-axis, and VOUT values are shown in volts (V) on the Y-axis. Plot diagram 400 includes waveforms illustrating voltages at the output terminal of bandgap reference generator 100 labeled VOUT versus temperature. Waveform 402 represents VOUT of the exemplary bandgap reference generator excluding resistor 132 as depicted in the $V_{CE}$ relationship of FIG. 2 with collector electrode of Q1 coupled directly to node CC2. Waveform 404 represents VOUT of the exemplary bandgap reference generator 100 as depicted in the $V_{CE}$ relationship of FIG. 3 including resistor 132. Because $V_{CE}$ values of Q1 and Q2 are offset by approximately 50 mV (FIG. 2), the corresponding VOUT waveform 402 shows degradation in temperature stability at temperatures above 100° C. Waveform 404, corresponding to VOUT of bandgap reference generator 100 with $V_{CE}$ values of Q1 and Q2 closely matched (FIG. 3), includes resistor 132 configured to have an IR drop substantially equal to an IR drop across resistor 130. VOUT waveform 404 shows significant improvement in bandgap reference generator temperature stability with desirable performance beyond 160° C.

Generally, there is provided, an integrated circuit including: a bandgap core circuit including: a first bipolar junction transistor (BJT); a second BJT having a control electrode coupled to a control electrode of the first BJT; a first resistor having a first terminal coupled to a first current electrode of the first BJT, and a second terminal coupled to a first current electrode of the second BJT; a second resistor having a first terminal coupled to second current electrode of the second BJT; and a cascode amplifier circuit having a first branch coupled to a second current electrode of the first BJT and a second branch coupled to a second terminal of the second resistor. The first resistor and second resistor may be configured to have IR drop across the second resistor be substantially equal to IR drop across the first resistor. The control electrode of the first BJT and the control electrode of the second BJT may each be coupled to a first voltage supply terminal. The bandgap core circuit may further include first current sources, the first current sources including: a first metal-oxide-semiconductor (MOS) transistor having a first current electrode coupled to the first branch of the cascode amplifier circuit and to the second current electrode of the first BJT, and a second current electrode coupled to the first voltage supply terminal; and a second MOS transistor having a first current electrode coupled to the second branch of the cascode amplifier circuit and to the second terminal of the second resistor, a second current electrode coupled to the first voltage supply terminal, and a control electrode coupled to a control electrode of the first MOS transistor. The bandgap core circuit may further include a third resistor having a first terminal coupled to the first current electrode of the second BJT, and a second terminal coupled to an output terminal of the bandgap core circuit. The cascode amplifier circuit may further include: a first current mirror including: a third MOS transistor having a first current electrode coupled to a second voltage supply terminal and a second current electrode coupled to a control electrode; a fourth MOS transistor having a first current electrode coupled to a second voltage supply terminal and a control electrode coupled to the control electrode of the third MOS transistor; a third BJT having a first current electrode coupled to the second current electrode of the third MOS transistor, and a second current electrode coupled to the second current electrode of the first BJT; and a fourth BJT having a first current electrode coupled to the second current electrode of the fourth MOS transistor, a second current electrode coupled to the second terminal of the second resistor, and a control electrode coupled to a control electrode of the third BJT, the control electrodes of the third and fourth BJTs coupled to receive a bias voltage; wherein the first branch includes the third MOS transistor and the third BJT, and the second branch includes the fourth MOS transistor and the fourth BJT. The integrated circuit may further include a bias circuit to provide the bias voltage, the bias circuit including: a fifth MOS transistor having a first current electrode coupled to the first voltage supply terminal, and a second current electrode coupled to control electrodes of the first, second, and fifth MOS transistors; a fifth BJT having a first current electrode coupled to the second current electrode of the fifth MOS transistor, and a second current electrode coupled to control electrodes of the third, fourth, and fifth BJTs; and a fourth resistor having a first terminal coupled to the second current electrode of the fifth BJT, and a second terminal coupled to the output of the bandgap core circuit. The integrated circuit may further include an output amplifier, the output amplifier including a sixth MOS transistor having a first current electrode coupled to the second voltage supply terminal, a control electrode coupled to the second current electrode of the fourth MOS transistor, and a second current electrode coupled to the output of the bandgap core circuit. The integrated circuit may further include a startup circuit, the startup circuit including: a seventh MOS transistor having a first current electrode coupled to the second voltage supply terminal, and a second current electrode coupled to the output of the bandgap core circuit; an eighth MOS transistor having a first current electrode coupled to the first voltage supply terminal, a control electrode coupled to the output of the bandgap core circuit, and a second current electrode coupled to a control electrode of the seventh MOS transistor; and a fifth resistor having a first terminal coupled to the second current electrode of the eighth MOS transistor, and a second terminal coupled to the second voltage supply terminal. The first voltage supply terminal may be characterized as a ground voltage supply terminal, and the second voltage supply terminal is characterized as a VDD voltage supply terminal.

In another embodiment, there is provided, an integrated circuit including: a bandgap core circuit including: a first bipolar junction transistor (BJT); a second BJT having a control electrode coupled to a control electrode of the first BJT; a first resistor having a first terminal coupled to a first current electrode of the first BJT, and a second terminal coupled to a first current electrode of the second BJT; a second resistor having a first terminal coupled to a second current electrode of the second BJT, the second resistor configured to have an IR drop substantially equal to an IR drop across the first resistor; a cascode amplifier circuit coupled to the bandgap core circuit, the cascode amplifier circuit including: a third BJT having a first current electrode coupled to the second current electrode of the first BJT; and a fourth BJT having a first current electrode coupled to the second terminal of the second resistor, and a control electrode coupled to a control electrode of the third BJT. The control electrode of the first BJT and the control electrode of the second BJT may each be coupled to a first voltage supply terminal. The bandgap core circuit may further include: a first metal-oxide-semiconductor (MOS) transistor having a first current electrode coupled to the first branch of the cascode amplifier circuit and to the second current electrode of the first BJT, and a second current electrode coupled to the first voltage supply terminal; and a second MOS transistor having a first current electrode coupled to the second branch of the cascode amplifier circuit and to the second terminal of the second resistor, a second current electrode coupled to the first voltage supply terminal, and a control electrode coupled to a control electrode of the first MOS transistor. The cascode amplifier circuit may further include: a third MOS transistor having a first current electrode coupled to a second voltage supply terminal, and a second current electrode coupled to a control electrode of the third MOS transistor; and a fourth MOS transistor having a first current electrode coupled to the second voltage supply terminal, and a control electrode coupled to the control electrode of the third MOS transistor. The bandgap core circuit may further include a third resistor having a first terminal coupled to the first current electrode of the second BJT, and a second terminal coupled to an output terminal of the bandgap core circuit. The integrated circuit may further include an output amplifier, the output amplifier including a fifth MOS transistor having a first current electrode coupled to a second voltage supply terminal, a control electrode coupled to the second current electrode of the fourth BJT, and a second current electrode coupled to the output of the bandgap core circuit. The integrated circuit may further include a bias circuit coupled to provide a bias voltage to the control electrodes of the third and fourth BJTs.

In yet another embodiment, there is provided, an integrated circuit including: a bandgap core circuit including: a first bipolar junction transistor (BJT); a second BJT having a base electrode coupled to a base electrode of the first BJT, the first BJT having an emitter area larger than an emitter area of the second BJT; a first resistor having a first terminal coupled to an emitter electrode of the first BJT, and a second terminal coupled to an emitter electrode of the second BJT; a second resistor having a first terminal coupled to a collector electrode of the second BJT, the second resistor configured to have an IR drop substantially equal to an IR drop across the first resistor; and a cascode amplifier circuit having a first branch coupled to a collector electrode of the first BJT and a second branch coupled to a second terminal of the second resistor. The emitter area of the first BJT may be at least substantially seven times the emitter area of the second BJT. The first branch may include a third BJT, the third BJT having an emitter electrode coupled to the collector electrode of the first BJT; and the second branch may include a fourth BJT, the fourth BJT having an emitter electrode coupled to the second terminal of the second resistor, and a base electrode coupled to a base electrode of the third BJT.

By now it should be appreciated that there has been provided, bandgap reference circuitry implemented on a semiconductor integrated circuit that generates a substantially constant reference voltage over an extended temperature range. A folded cascode circuit coupled to a bandgap core circuit allows transistors Q1 and Q2 of the bandgap to operate in a saturation mode. An equalizer circuit including a resistor equalizes $V_{CE}$ values of transistors Q1 and Q2 by matching a voltage drop across the resistor with a voltage drop across a $\Delta V_{BE}$ resistor coupled to Q1 and Q2. With $V_{CE}$ values of transistors Q1 and Q2 matched, extended temperature stability is realized in saturation mode.

Because the apparatus implementing the present invention is, for the most part, composed of electronic components and circuits known to those skilled in the art, circuit details will not be explained in any greater extent than that considered necessary as illustrated above, for the understanding and appreciation of the underlying concepts of the present invention and in order not to obfuscate or distract from the teachings of the present invention.

Although the invention has been described with respect to specific conductivity types or polarity of potentials, skilled artisans appreciated that conductivity types and polarities of potentials may be reversed.

Moreover, the terms "front," "back," "top," "bottom," "over," "under" and the like in the description and in the claims, if any, are used for descriptive purposes and not necessarily for describing permanent relative positions. It is understood that the terms so used are interchangeable under appropriate circumstances such that the embodiments of the invention described herein are, for example, capable of operation in other orientations than those illustrated or otherwise described herein.

Architectures depicted herein are merely exemplary, and that in fact many other architectures can be implemented which achieve the same functionality. In an abstract, but still definite sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected," or "operably coupled," to each other to achieve the desired functionality.

Furthermore, those skilled in the art will recognize that boundaries between the functionality of the above described operations are merely illustrative. The functionality of multiple operations may be combined into a single operation, and/or the functionality of a single operation may be distributed in additional operations. Moreover, alternative embodiments may include multiple instances of a particular operation, and the order of operations may be altered in various other embodiments.

Although the invention is described herein with reference to specific embodiments, various modifications and changes can be made without departing from the scope of the present invention as set forth in the claims below. Accordingly, the specification and figures are to be regarded in an illustrative rather than a restrictive sense, and all such modifications are intended to be included within the scope of the present invention. Any benefits, advantages, or solutions to problems that are described herein with regard to specific embodiments are not intended to be construed as a critical, required, or essential feature or element of any or all the claims.

Furthermore, the terms "a" or "an," as used herein, are defined as one or more than one. Also, the use of introductory phrases such as "at least one" and "one or more" in the claims should not be construed to imply that the introduction of another claim element by the indefinite articles "a" or "an" limits any particular claim containing such introduced claim element to inventions containing only one such element, even when the same claim includes the introductory phrases "one or more" or "at least one" and indefinite articles such as "a" or "an." The same holds true for the use of definite articles.

Unless stated otherwise, terms such as "first" and "second" are used to arbitrarily distinguish between the elements such terms describe. Thus, these terms are not necessarily intended to indicate temporal or other prioritization of such elements.

What is claimed is:

1. An integrated circuit comprising:

a bandgap core circuit including:

a first bipolar junction transistor (BJT);

a second BJT having a control electrode coupled to a control electrode of the first BJT;

a first resistor having a first terminal coupled to a first current electrode of the first BJT, and a second terminal coupled to a first current electrode of the second BJT;

a second resistor having a first terminal coupled to a second current electrode of the second BJT; and a cascode amplifier circuit having a first branch coupled to a second current electrode of the first BJT and a second branch coupled to a second terminal of the second resistor.

2. The integrated circuit of claim 1, wherein the first resistor and second resistor are configured to have an IR drop across the second resistor be substantially equal to an IR drop across the first resistor.

3. The integrated circuit of claim 1, wherein the control electrode of the first BJT and the control electrode of the second BJT are each coupled to a first voltage supply terminal.

4. The integrated circuit of claim 1, wherein the bandgap core circuit further includes first current sources, the first current sources comprising:

a first metal-oxide-semiconductor (MOS) transistor having a first current electrode coupled to the first branch of the cascode amplifier circuit and to the second current electrode of the first BJT, and a second current electrode coupled to the first voltage supply terminal; and a second MOS transistor having a first current electrode coupled to the second branch of the cascode amplifier circuit and to the second terminal of the second resistor, a second current electrode coupled to the first voltage supply terminal, and a control electrode coupled to a control electrode of the first MOS transistor.

5. The integrated circuit of claim 4, wherein the bandgap core circuit further includes a third resistor having a first terminal coupled to the first current electrode of the second BJT, and a second terminal coupled to an output terminal of the bandgap core circuit.

6. The integrated circuit of claim 5, wherein the cascode amplifier circuit further includes:

a first current mirror comprising:

a third MOS transistor having a first current electrode coupled to a second voltage supply terminal and a second current electrode coupled to a control electrode;

a fourth MOS transistor having a first current electrode coupled to the second voltage supply terminal and a control electrode coupled to the control electrode of the third MOS transistor;

a third BJT having a first current electrode coupled to the second current electrode of the third MOS transistor, and a second current electrode coupled to the second current electrode of the first BJT; and a fourth BJT having a first current electrode coupled to the second current electrode of the fourth MOS transistor, a second current electrode coupled to the second terminal of the second resistor, and a control electrode coupled to a control electrode of the third BJT, the control electrodes of the third and fourth BJTs coupled to receive a bias voltage;

wherein the first branch includes the third MOS transistor and the third BJT, and the second branch includes the fourth MOS transistor and the fourth BJT.

7. The integrated circuit of claim 6, further comprising a bias circuit to provide the bias voltage, the bias circuit including:

a fifth MOS transistor having a first current electrode coupled to the first voltage supply terminal, and a second current electrode coupled to a control electrode of the fifth MOS transistor and the control electrodes of the first and second MOS transistors;

a fifth BJT having a first current electrode coupled to the second current electrode of the fifth MOS transistor, and a second current electrode coupled to control electrodes of the third, fourth, and fifth BJTs; and a fourth resistor having a first terminal coupled to the second current electrode of the fifth BJT, and a second terminal coupled to the output of the bandgap core circuit.

8. The integrated circuit of claim 6, further comprising an output amplifier, the output amplifier including a sixth MOS transistor having a first current electrode coupled to the second voltage supply terminal, a control electrode coupled to the second current electrode of the fourth MOS transistor, and a second current electrode coupled to the output of the bandgap core circuit.

9. The integrated circuit of claim 8, further comprising a startup circuit, the startup circuit including:

a seventh MOS transistor having a first current electrode coupled to the second voltage supply terminal, and a second current electrode coupled to the output of the bandgap core circuit;

an eighth MOS transistor having a first current electrode coupled to the first voltage supply terminal, a control electrode coupled to the output of the bandgap core circuit, and a second current electrode coupled to a control electrode of the seventh MOS transistor; and a fifth resistor having a first terminal coupled to the second current electrode of the eighth MOS transistor, and a second terminal coupled to the second voltage supply terminal.

10. The integrated circuit of claim 6, wherein the first voltage supply terminal is characterized as a ground voltage supply terminal, and the second voltage supply terminal is characterized as a VDD voltage supply terminal.

11. An integrated circuit comprising:

a bandgap core circuit including:

a first bipolar junction transistor (BJT);

a second BJT having a control electrode coupled to a control electrode of the first BJT;

a first resistor having a first terminal coupled to a first current electrode of the first BJT, and a second terminal coupled to a first current electrode of the second BJT;

a second resistor having a first terminal coupled to a second current electrode of the second BJT, the second resistor configured to have an IR drop substantially equal to an IR drop across the first resistor;

a cascode amplifier circuit coupled to the bandgap core circuit, the cascode amplifier circuit including:

a third BJT having a first current electrode coupled to a second current electrode of the first BJT; and a fourth BJT having a first current electrode coupled to a second terminal of the second resistor, and a control electrode coupled to a control electrode of the third BJT.

12. The integrated circuit of claim 11, wherein the control electrode of the first BJT and the control electrode of the second BJT are each coupled to a first voltage supply terminal.

13. The integrated circuit of claim 12, wherein the bandgap core circuit further includes:

a first metal-oxide-semiconductor (MOS) transistor having a first current electrode coupled to the second current electrode of the first BJT, and a second current electrode coupled to the first voltage supply terminal; and a second MOS transistor having a first current electrode coupled to the second terminal of the second resistor, a second current electrode coupled to the first voltage supply terminal, and a control electrode coupled to a control electrode of the first MOS transistor.

14. The integrated circuit of claim 13, wherein the cascode amplifier circuit further includes:

a third MOS transistor having a first current electrode coupled to a second voltage supply terminal, and a second current electrode coupled to a control electrode of the third MOS transistor; and a fourth MOS transistor having a first current electrode coupled to the second voltage supply terminal, and a control electrode coupled to the control electrode of the third MOS transistor.

15. The integrated circuit of claim 11, wherein the bandgap core circuit further includes a third resistor having a first terminal coupled to the first current electrode of the second BJT, and a second terminal coupled to an output terminal of the bandgap core circuit.

16. The integrated circuit of claim 15, further comprising an output amplifier, the output amplifier including a fifth MOS transistor having a first current electrode coupled to a second voltage supply terminal, a control electrode coupled to a second current electrode of the fourth BJT, and a second current electrode coupled to the output terminal of the bandgap core circuit.

17. The integrated circuit of claim 11, further comprising a bias circuit coupled to provide a bias voltage to the control electrodes of the third and fourth BJTs.

18. An integrated circuit comprising:

a bandgap core circuit including:

a first bipolar junction transistor (BJT);

a second BJT having a base electrode coupled to a base electrode of the first BJT, the first BJT having an emitter area larger than an emitter area of the second BJT;

a first resistor having a first terminal coupled to an emitter electrode of the first BJT, and a second terminal coupled to an emitter electrode of the second BJT;

a second resistor having a first terminal coupled to a collector electrode of the second BJT, the second resistor configured to have an IR drop substantially equal to an IR drop across the first resistor; and a cascode amplifier circuit having a first branch coupled to a collector electrode of the first BJT and a second branch coupled to a second terminal of the second resistor.

19. The integrated circuit of claim 18, wherein the emitter area of the first BJT is at least substantially seven times the emitter area of the second BJT.

20. The integrated circuit of claim 18, wherein:

the first branch includes a third BJT, the third BJT having an emitter electrode coupled to the collector electrode of the first BJT; and the second branch includes a fourth BJT, the fourth BJT having an emitter electrode coupled to the second terminal of the second resistor, and a base electrode coupled to a base electrode of the third BJT.

* * * * *